US006155437A

United States Patent [19]

Rassent

[11] Patent Number: 6,155,437

[45] Date of Patent: Dec. 5, 2000

[54] DISPLAY DEVICE FOR SMALL CONTAINERS AND CONTAINERS THUS DISPLAYED

[75] Inventor: Gérard Rassent, Courbevoie, France

[73] Assignee: Societe MBCG, France

[21] Appl. No.: 08/890,588

[22] Filed: Jul. 9, 1997

[51] Int. Cl.[7] ..... A47F 5/00

[52] U.S. Cl. ..... 211/59.3; 312/71

[58] Field of Search ..... 211/59.3, 59.2; 312/61, 71

[56] References Cited

U.S. PATENT DOCUMENTS 5,240,125 8/1993 Kunz ..... 211/59.3

5,366,099 11/1994 Schmid ..... 211/59.3

5,542,552 8/1996 Yablans et al. ..... 211/59.3

5,665,304 9/1997 Heinen et al. ..... 211/59.3 X

*Primary Examiner*—Robert W. Gibson, Jr.

*Attorney, Agent, or Firm*—Bierman, Muserlian and Lucas

[57] ABSTRACT

The invention pertains to the field of mechanics, and more precisely to articles for marketing commercial objects. A display device for small containers is described, which holds and advances said containers as they are sold, comprising an assembly of two movable parallel strips and of a spring pusher member that slides along a horizontal groove intermediate the strips and abuts against the last container in the row between the two strips. The device is useful for displaying containers for commercial purposes.

4 Claims, 3 Drawing Sheets

DISPLAY DEVICE FOR SMALL CONTAINERS AND CONTAINERS THUS DISPLAYED

PRIOR ART

The prior art is best illustrated by the following references.

WO-A-91 015 141 (to Yablans Gerald)
Swiss patent A 280 424 (to Michel)
European patent application n° 0 365 424 (to Lauterbach Jacques)
U.S. Pat. No. 5,366,099 (to Schmid Michael)
U.S. Pat. No. 3,452,899 (to Libberton Albert C)

SUMMARY OF THE INVENTION

This invention pertains a display device for small flasks insuring the holding and the forward movement of them, in the display device as they are sold. This device is comprised of an assembly of two mobile parallel strips and a spring pusher which slide along and inside a horizontal groove fitted between both strips and coming to abut against the last flask of the row, located inside these two strips.

This display device finds utility in the trade for offering to the consummer's attention flask of perfumes, drinks or valuable goods.

BEST EMBODIMENTS OF THE INVENTION

This invention particularly relates to a device for displaying small containers intended to focus the consumer's attention to a more particular attraction which will allows him to guide his choice.

Specifically the invention is related to a display device for small containers insuring the supporting and the forward movement as they are sold, characterized in that it is formed of an assembly of two parallel rigid strips and of a spring pushing member sliding along a horizontal groove between the two strips and which abuts against the last container of the row, positionned inside the two strips.

The two parallel strips display two vertical faces. They are movable and may laterally move in a movable manner. They come to abut inwardly against a front hood borne by an ensemble made of two horizontal strips, fastened to at the front on the head-on bonnet and bearing at the lower face, a series of quadratic bases.

The device is also characterized by the fact that the two movable strips may come to laterally slide to the inside or to the outside, by means of two fastening flaps which are inserted in the bases borne by the two horizontal strips. These two horizontal strips are not butt-jointed and have between them, a groove between which circulate the guide of the pusher member in order to press the containers located between the two assembled strips.

The bases borne by the two strips are made of a prismatic structure. They are permanently fastened beneath both strips and are symetrically arranged on these strips. Each of the strip alternatively bears one or two small tongues orthogonally secured to the internal wall. The disposal of said small tongues is such that for an assembly including two small tongues on one side, it corresponds with the other strip which bears only one small tongue and vice et versa. The spacing provided between each small tongue is such that the other small tongue set out on the other strip, may insert itself between the other small tongues.

This ensemble of small tongues sliding between them, which secure the motility of the whole and allows the lateral moving, is unique or simultaneous of the two strips to the outside or to the inside. In this way, the housing provided between the two strips is adapted to the dimensions of the container and insure the positioning without looseness or excessive tightness.

The aim is that, once the containers have been positionned, using an appropriate displacement of the strips, the pusher to which a reel of metallic band is set, may run backward until the containers are well positionned and in a sufficient number while pressing them by the front plane side of said pusher. The pusher may then by relaxing, run forward against the last container located between the strips.

The pusher is of paralielipepedic shape including at its base a vertical tab bearing at its lower end, a horizontal plane surface of larger dimension which insure the sliding of the pusher in the central groove located between the strips. Inside the pusher, there has been mounted in a permanent manner an axis on which comes winding the metallic band kept positionned at its other end with a housing placed at the end of the two half-strips forming the groove. Thus the two half-strips are fastened together at one end by a housing in which the metallic band is inserted and to which it is secured. In this manner the metallic band may unwind in a supple manner without any risk of breakage while maintaining a strong strength on the pusher.

The device of this invention may still be characterized by the presence on the front side of the front hood of rectangular shape and bearing at its lower end a protruding edge. This is used as a support for a second device for displaying, vertically disposed at the lower part of the front hood and which is inserted by running, inside a fitting housing located in the upper part of this second displaying device. This fitting housing of oblong shape shows at its internal side a quadrangular indentration in which the ward may penetrate and on which the protruding edge abuts. In this manner the second device comes fitting together on this edge and is held in position in a removable manner. By upward running this second display may be removed and it may be disposed therein another bottle as it is needed.

The thus defined two devices have as an object to show to the consumers one or two kinds of bottles disposed on the display device. Thus the second device shows at the end of a rigid incurvated arm of the same material, a platform showing a hollow rounded plane in which the display bottle is placed. On the contrary in the device between the strips, the article to be sold or a different article—it may be displayed under its own packaging or under its own labelling and sealing—in order that the public's attention be also attracted by the quality of the display.

Moreover this double device is intended to be placed on shelves or displayed in windows in such a manner that the second display device will be immediately visible and that the first display device positioned slightly above and set back, constitutes an ensemble of bottles in stock, in which the salesman or the consumer will pick the one or several bottles which are necessary for him.

Figure 1:
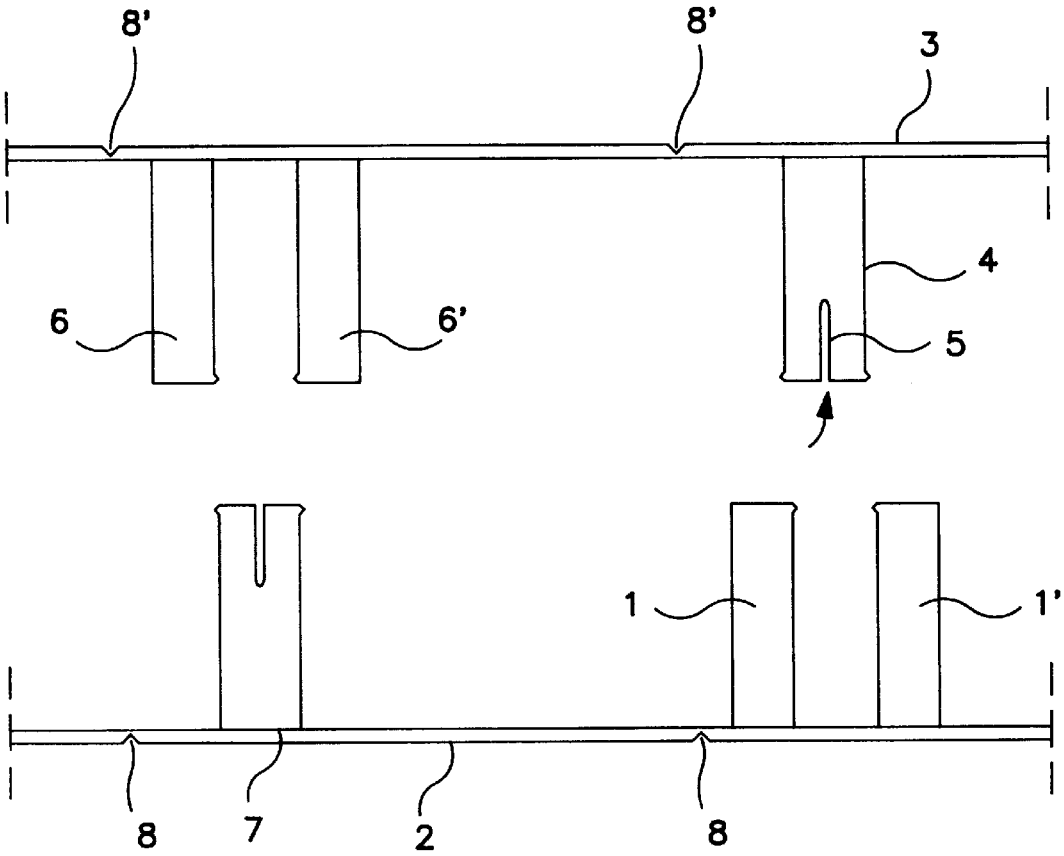
FIG. 1 is a schematic view of an embodiment of the invention.

In a mode of performance depicted at FIG. 1, it has been shown the small tongues (1) (1') on a setting stick (2) between them, another small tongue (4) which comes from the opposite setting stick (3), bearing in its center an oblong slot (5), comes to be inserted and on the other side the symetrical disposal with two small tongues (6) (6') on the opposite side, between them the single small tongue (7) borne by the opposite setting stick (2) comes to be inserted.

The small tongues as well as the setting sticks are made of rigid material such as shock-resistant plastic material, but having a slight tensility to be able to move between the small tongues or to run for sliding without any risk of breaking. This material may be coloured or tinted to reproduce the colours of the bottles which are disposed therein.

The small tongues are rigid, horizontally arranged tabs of rectangular section. Their section is fitted to the measurement of the horizontal slot borne by the two half setting sticks. This space is calculated in order as the tabs come easily and effortlessly to be inserted, but that their positioning be exactly fitted to the measurements of the slots with the minimum possible of free movement.

Figure 2:
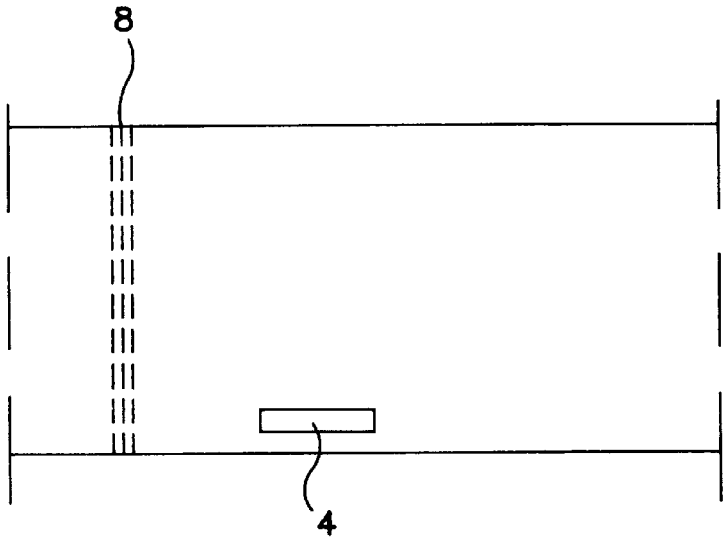
FIG. 2 is a second embodiment to hold large bottles.

In another mode of performance pictured at FIG. 2, the central half setting sticks have been more extensively proportioned and the small tongues have been lengthened in order to achieve a space of larger size thus allowing to receive bigger bottles. Whereas in the previously described device the maximal spacing of the small tongues left an available space of about 20 mm in the presently herein defined mode of performance this space reaches 40 mm. For this doing, it may be counted on the breadth of the two half sticks and (or on the length of the small tongues. The two half-sticks which determine the central groove, each include a vertical longitudinal edge intended to secure the positioning and the tightening of the bottles.

Figure 3A:
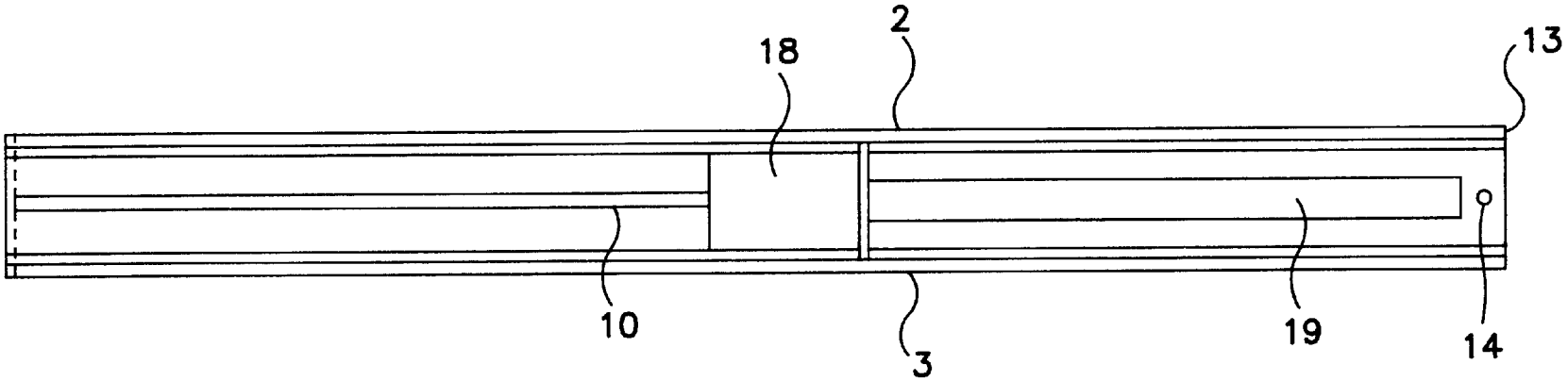
FIGS. 3A and 3B are top views of the devices of FIGS. 1 and 2.
Figure 3B:
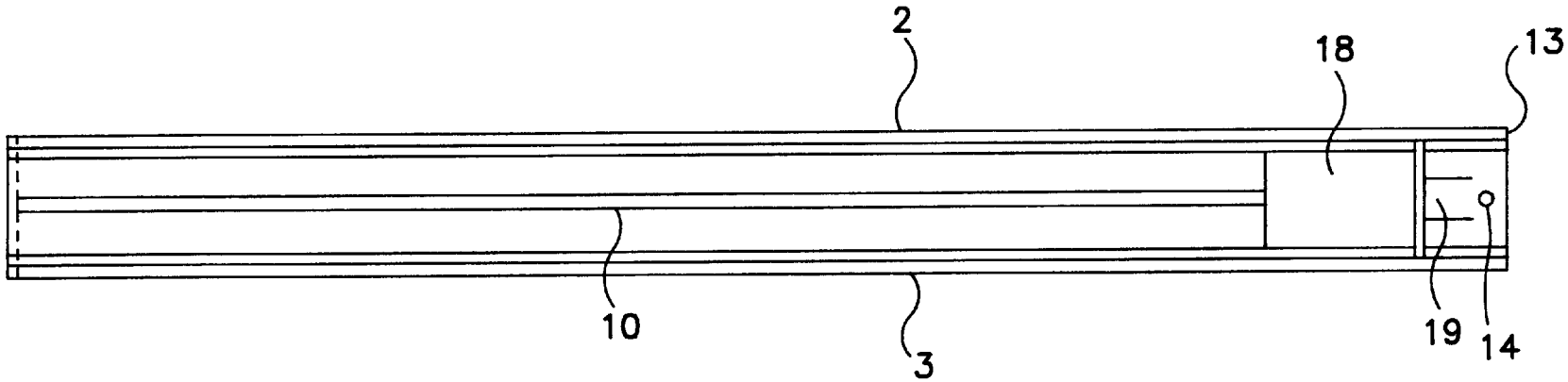

FIGS. 3A and 3B depict the display device seen from above, as a whole. The model A is the small-sized device, the model B is the large-sized device.

The two vertical sticks (2) and (3) are seen therein, placed side by side to the two strips (9) (9') separated by the groove (10) in which the pusher (11) runs. The latter arises before the housing (12) in which the metallic band (not shown), acting as a spring, is wound. The two strips (9) (9') are assembled together on the front edge of the device (13). The opening (14) is used to receive the solidarizing means maintaining the metallic band in the housing.

FIGS. 3A and 3B show in side ways the housings (16) (16') (16") in the openings (15) (15') (15") of which the small tongues (6) (6') and (7) come to be inserted. These housings are borne by each of the strips (17). It is also pictured the front edge (13). The cracking line (8) located in the strip (17) is shown. It suppresses every symetrical disposal of the housings (16).

Figure 4:
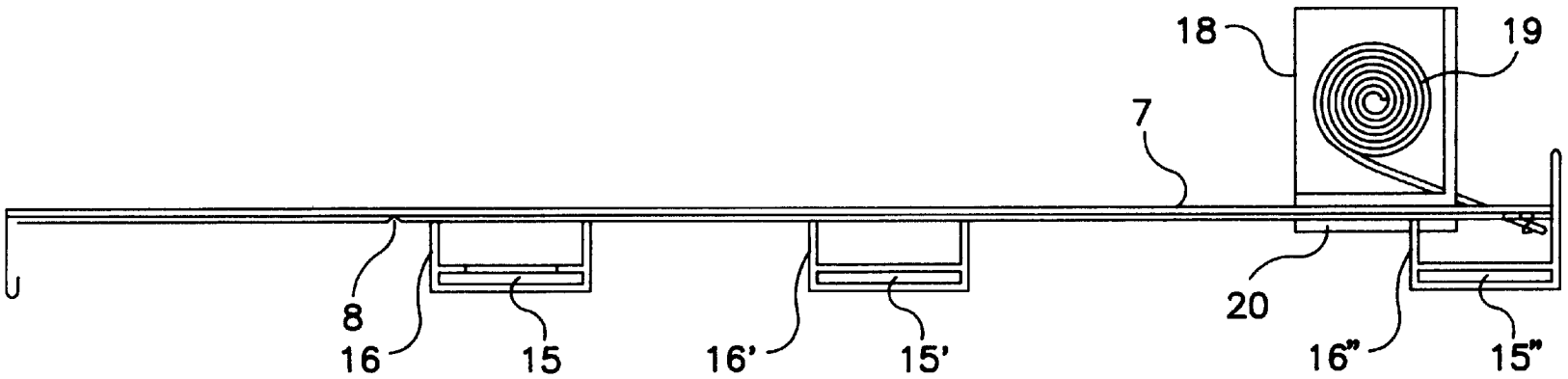
FIG. 4 is a side view of FIG. 3B.
Figure 5:
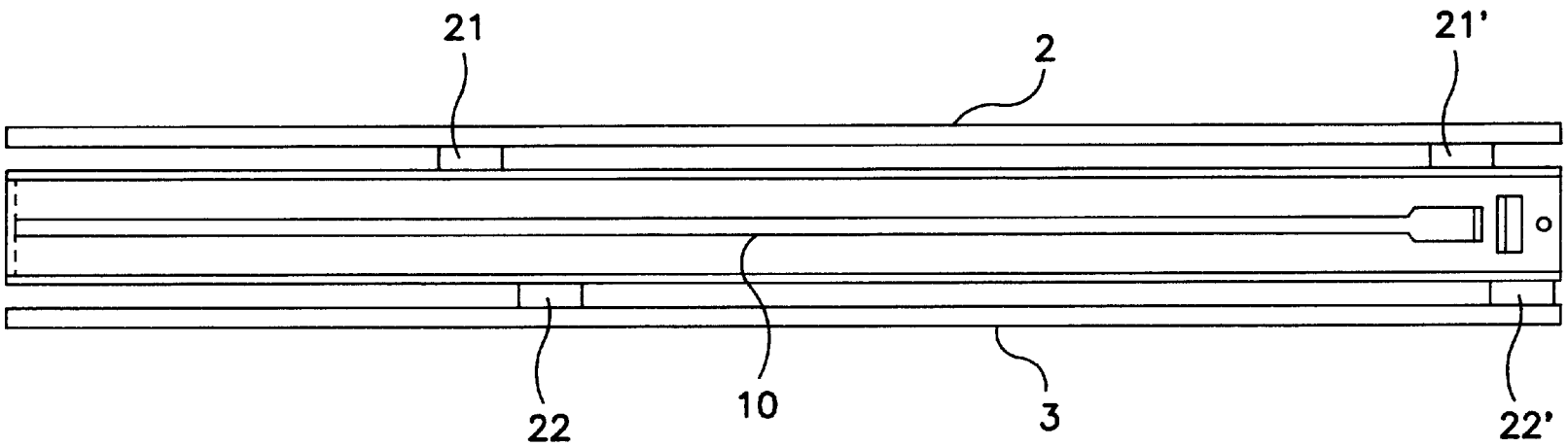
FIG. 5 is a plan view to illustrate the spring pusher member, the guide and the fastening flaps.

FIG. 5 is a plan view of the present invention in which C) the rigid strips (2,3) comprise two fastening flaps (21,21') and (22,22'). The fastening flaps are inserted in the openings (15) and (15') of the base borne by the two strips as illustrated in FIG. 4 whereby the rigid strips are allowed to be laterally inwardly or outwardly moveable to let a space between the rigid strips which is to be adjusted to the dimensions of the containers. FIGS. 3A and 3B are plan views of the present invention which illustrate the spring pusher member 18 guided between the assembly of two parallel disposed strips (9,9') in sliding in a horizontal groove separating two horizontal strips assembled together. FIG. 4A is a lateral view of the present invention illustrating the mode of operation of the spring pusher member (18) which contains a spring (19) illustrated in FIGS. 3A and 3B and a guide (20).

What is claimed is:

1. In a device for displaying a row of small containers for holding and moving forward for the dispensing of the containers as they progress, the device being made of an assembly of two parallel disposed strips in rigid plastic material, fitted with a spring pusher member guided between them and sliding in a horizontal groove separating two horizontal strips assembled together, the improvement which consists in the fact that the said rigid strips comprises two fastening flaps which are inserted in the base borne by the two strips to allow the rigid strips to be laterally inwardly or outwardly movable to let a space between these rigid strips which is to be adjusted to the dimensions of the said containers, and in that each of the rigid strips alternatively bears one or two small tongues secured perpendicularly to the internal wall of each rigid strip to allow the adjustment to the dimensions of the containers, said small tongues being disposed in such manner that in an assembly including two small tongues on one rigid strip, the opposite strip bears only one small tongue, the one small tongue coming to be inserted between the said two small tongues and the symmetrical disposal with two small tongues on the opposite strip, between them the single small tongue borne by the opposite setting stick comes to be inserted within.

2. The improvement of claim 1 wherein the two parallel strips come arrest inwardly against a front hood borne by a member formed of two horizontal strips secured to the front of the front hood.

3. The improvement of claim 1 wherein the groove between the two horizontal strips allows the guide of the pusher to press the containers inserted between the two strips.

4. The improvement of claim 1 wherein the spring pusher member has at its bottom a vertical tab which bears on its lower end against a horizontal plane surface of bigger section.

* * * * *